US005479753A

United States Patent [19]

Williams

[11] Patent Number: 5,479,753

[45] Date of Patent: Jan. 2, 1996

[54] PROCESS FOR SEALING A SLOPED METAL ROOF

[76] Inventor: Charles T. Williams, 19153 Fruitport Rd., Spring Lake, Mich. 49456

[21] Appl. No.: 298,190

[22] Filed: Aug. 31, 1994

[51] Int. Cl.[6] ..... E04B 1/00

[52] U.S. Cl. ..... 52/741.4; 52/411; 52/746.11

[58] Field of Search ..... 52/741.4, 409, 52/410, 411, 412, 746, 746.1, 516; 156/196, 308.2, 309.6

[56] References Cited

U.S. PATENT DOCUMENTS

| | | | |
|---|---|---|---|
| 4,597,234 | 7/1986 | Simpson . | |
| 4,873,807 | 10/1989 | Filip | 52/410 X |
| 5,018,329 | 5/1991 | Hasan et al. | 52/741.4 X |
| 5,392,583 | 2/1995 | Gregory | 52/411 |

*Primary Examiner*—Carl D. Friedman

*Assistant Examiner*—Creighton Smith

*Attorney, Agent, or Firm*—Waters & Morse

[57] ABSTRACT

A process for sealing roof seams in a corrugated sloped metal roof comprises applying elongated strips of a flexible hot melt thermoplastic bituminous composite material to the seams and the edges of the roof surface immediately adjacent thereto but not over the whole roof surface. The bituminous composite material has an elevated operating temperature of about 500°–600° F. or greater. The bituminous composite material is heated to at least a point wherein the material becomes soft and semi-molten so as to conform to the surface of the roof and the convolutions of the corrugations and bonds to the roof surface. Prior to applying the bituminous composite material, a compatible metal primer is applied to the roof seams. The bituminous composite material is troweled into shape while it is still hot. An alternative application method comprises applying the material between overlapping roof sheets.

13 Claims, 1 Drawing Sheet

PROCESS FOR SEALING A SLOPED METAL ROOF

BACKGROUND OF THE INVENTION

1. Field Of The Invention:

The present invention relates to a process for sealing roof seams in a sloped metal roof by the application of a thin strip of hot melt bituminous composite material to the roof seam alone.

2. Description Of Prior Art:

Metal buildings are in widespread use for a number of industrial and other applications. Typically, such buildings have sloped metal roofs, wherein corrugated metal sheets are mounted in overlapping fashion on an underlying roof framework by metal fasteners. A so-called "standing seam" metal roof is considered herein to be a corrugated metal roof. When new, roofing sheets are typically pre-painted and are fastened down by screws, with overlapping seams having a caulk-type of sealer between the overlapping portions of the seam. The screws have neoprene gaskets sealing the openings in the roof sheeting beneath the heads of the threaded fasteners. Sloped metal roofs are largely self-supporting and rely on the slope of the roof to minimize damage due to snow, ice, and water build-up on the roof. The corrugations in the metal sheeting are responsible for the deflection resistance of the roof.

Over a period of time, a sloped metal roof is subject to the adverse affects of weather. Ultraviolet radiation eventually disintegrates the neoprene gaskets around the fasteners, until the fasteners become loose. The weight of snow and other weather effects on the roof cause the overlapping sheets of roofing to move relative to each other, and the loosened screws facilitate this movement. The movement wears and causes cracks in the dried out caulk between the overlapping roof seams and eventually produces leaks in the roof seams.

A sloped metal roof cannot be repaired in the same way that a flat roof is repaired, which is typically by recovering the entire roof surface with a heavy roofing product or membrane formed of bituminous (asphalt) or composite materials. A sloped metal roof is not designed to support a lot of weight and cannot withstand the weight of such heavy roofing products over the entire roof. For many years, one typical way of resealing a sloped metal roof has been to apply caulk over the seams, apply a layer of screen over the caulk and then apply another layer of caulk over the screen. A "peel-and-stick" butyl tape or other such membrane applied over the roof seams also are known processes.

The problem with the known processes is, simply, that they do not work very well, and the roof returns to its leaky condition over a short period of time.

An object of the present invention is to overcome the long existing problem of sealing roof seams in a sloped metal roof.

SUMMARY OF THE INVENTION

In accordance with the present invention, a process for sealing a sloped metal roof, wherein separate sheets of corrugated metal sheeting overlap to form sloped roof seams, comprises applying elongated strips of a flexible hot melt thermoplastic bituminous composite sheet material to the seams and the edges of the roof surface immediately adjacent thereto but not over the whole roof surface. The bituminous composite material has an elevated operating temperature which requires that the product be heated substantially to achieve bonding on the metal roof during application. The preferred material has an operating temperature of about 500°–600° F. The underside of the bituminous composite material is heated to the operating temperature, at which point the underside of the material becomes soft and semi-molten so as to conform to the surface of the roof and the convolutions of the corrugations and bonds to the roof surface.

In the present invention, the roof is first prepared by removing and replacing the screws with new screws and new rubber washers. Then a metal primer (preferably an asphalt primer) is applied to the roof surface. Finally, the bituminous composite material is applied to the roof surface and is simultaneously heated with a blow torch or other heater to the operating temperature as the bituminous composite material is unrolled over the seams. This can be done after the primer has dried or while the primer is still tacky. The bituminous composite material is troweled into place while the material is still hot in order to eliminate air voids and produce feathered edges. The bituminous composite material is formed in various widths to cover different types of seams. Rolls six to twelve inches wide are successfully used for most sloped and field seams of a roof.

As used herein, the term "hot melt bituminous composite material" or "bituminous composite material" refers to a product commonly known as "torch down" or "heat weld" material and is available commercially. Hot melt sheet materials have been used to cover entire roof surfaces for roofs such as flat roofs but they have not been used for sloped metal roof seam repairs. The bituminous composite material preferably is a composite product comprising a type 4 asphalt incorporating a toughening additive, such as a polymer plastic resin or Teflo, and impregnated in a non-woven polyester material. The material is relatively thick compared to conventional roofing felt or tar paper.

When a roof is sealed or resealed using the process of the present invention, the sealed surfaces are bonded very tightly and are resistant to failure due to heat, cold, moisture, and roof movement. The process provides such a superior seal that sealed roof seams can be expected to survive for at least ten years, which is many years longer than any other products or processes currently available.

These and other features of the present invention are shown and described in more detail in the drawings and description of preferred embodiment set forth below.

DETAILED DESCRIPTION OF PREFERRED EMBODIMENTS

Figure 1:
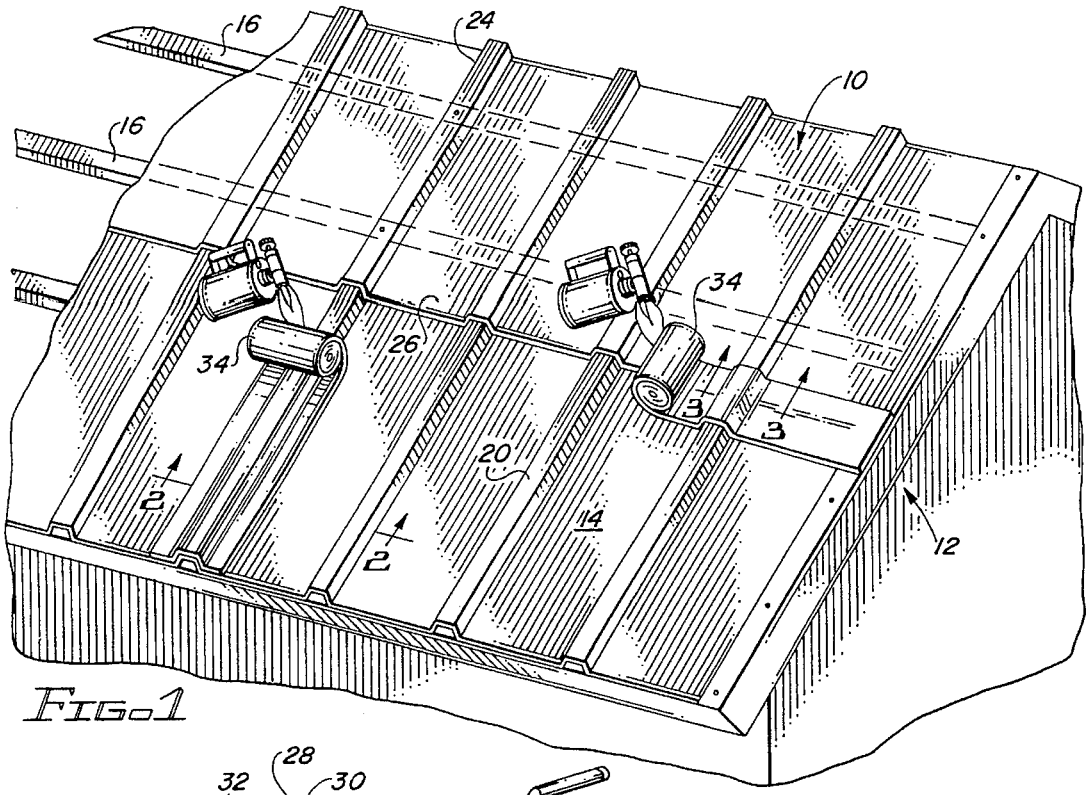
FIG. 1 is a perspective view of a sloped metal roof showing the application of the process of the present invention in sealing both sloped seams and field seams of the roof.

Referring now to the drawings, a sloped metal roof 10 is shown in FIG. 1 mounted on a building 12 by means of metal or wood trusses and purlins 16 that run longitudinally the length of the building between the peaks. The metal roof comprises a plurality of sheets of relatively thin corrugated sheet metal sections 14 that are screwed down on the purlins 16. The metal roof is typically formed of sheet thirty-two to thirty-six inches wide and sixteen to twenty-four feet long, with the steel having ribs or corrugations 20 running longitudinally in the sloped direction along the sheets about ten inches apart, with the ribs or corrugations being about one and one quarter inches high and one and one-half inches wide and being tapered inwardly from the base to the top of the corrugations.

Each metal sheet has several ribs 20 and terminates at one edge with a complete rib 20' and at the other edge with a rib 20" having a short flange 22 extending beyond the rib.

The roofing sheets overlap at sloped edges to form "sloped seams" 24, and they overlap laterally to form what are known as "field seams" 26. Both types of seams require re-sealing after a roof has been in use for a period of time, and both types of seams are effectively sealed with the process of the present invention.

Figure 2:
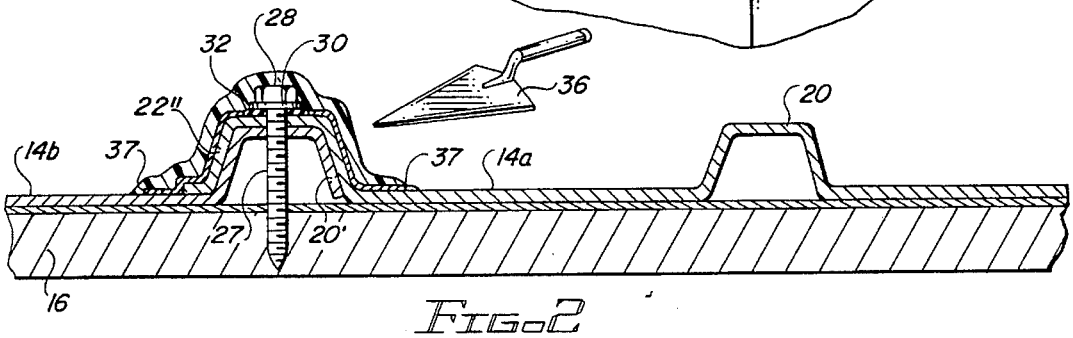
FIG. 2 is a cross sectional view taken along line 2—2 of FIG. 1.

Referring to FIG. 2, rib 20" of sheet 14*a* fits over rib 20' of sheet 14*b*, with flange 22 extending slightly beyond the overlapping ribs. A screw fastener 27 extends through aligned openings in the tops of the respective ribs and screws into an opening in purlin 16. A head 28 on the screw bears against a metal washer 30, which compresses a rubber gasket or seal 32 in order to seal the hole formed by the screw.

In order to re-seal the field and slope seams in this metal roof, the following steps are employed in the process of the present invention:

First, the roof is prepared. The existing screws are removed and replaced with new screws and new rubber washers. The screws will be under the bitumen material so will not be subject to ultraviolet radiation damage. A metal washer 30 between the head 28 of the fastener and the rubber washer provides an even compression of the rubber washer and improves the seal. In addition to screw replacement, the roof seams are cleaned to remove dirt, debris, and loose paint.

Then a primer layer 37 is applied to the roof seams. The primer preferably is a conventional asphalt metal primer. The primer enhances the bond of the bituminous composite material to the roof surface.

After the primer has been applied, a strip of bituminous composite material 38 is applied to the roof. The bituminous composite material is conveniently produced in rolls 6, 8, or 12 inches in width, with the bituminous composite material comprising flexible sheets having the general appearance of tar paper except that it is much thicker and is harder and stiffer and stronger. A significant feature of the bituminous composite material of the present invention, however, is that it is a high melt thermoplastic bituminous composite material commonly referred to as "torch down" or "heat weld". This material has an elevated operating temperature that requires substantial heating before the material reaches a state where it will bond securely with a primed metal roof surface. The preferred material has an operating temperature of about 500°–600° F. and becomes semi-molten at that temperature. The material is applied to the roof by heating the underside of the material with a heating implement, such as a blow torch, simultaneously with application of the material to the roof surface (which is heated in the process). A blow torch creates a flame of about 1500° F. and heats the surface of the material to its operating temperature. Other heating means such as hot air or ultrasonic heating could be employed. At the operating temperature, the material becomes soft and semi-molten as it starts to melt, and it conforms with the convoluted shape of the roof and forms a bond with the underlying primer material. In addition, as the material is being unrolled from rolls 34 onto the roof surface, a trowel 36 is used to press the bituminous composite material into its proper shape. Troweling eliminates voids between the material and the underlying roof surface and feathers the edges of the bituminous composite material into a smooth edge where the bituminous composite material meets the roof surface. This enhances bonding and impairs moisture penetration between the bituminous composite material and the roof at the edge of the bituminous composite material. Preferably, the trowel is heated in order to keep the material soft as it is being troweled.

The bituminous composite material 38 is rolled over the entire length of the roof sloped seams 24, as shown in FIG. 1, and is also rolled over the entire length of the field seams 26, as shown in FIG. 1. The bituminous composite material covers only the seams and the adjacent roof surface, however, and does not cover the entire roof surface itself. A sloped metal roof is a relatively light weight roof and could not be expected to bear the additional weight of a torch down sheet over the entire roof surface.

In the preferred practice of the present invention, the hot melt bituminous composite material is sometimes called a modified bitumen. A product manufactured by GAF called APP Modified Bitumen works especially well in the present invention. This product is called torch down by GAF. However, other manufacturers call similar products "heat weld". Other similar products will work.

Figure 3:
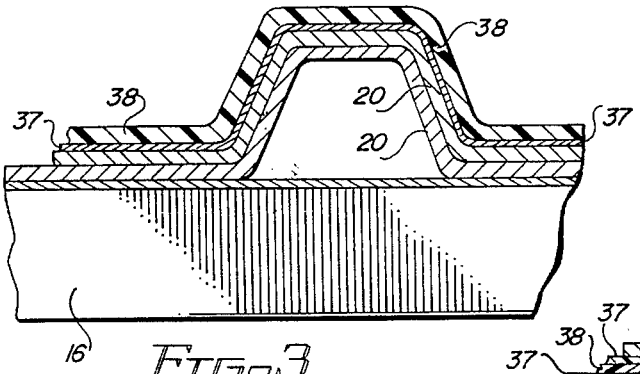
FIG. 3 is a cross sectional view taken along line 3—3 of FIG. 1.

The bituminous composite material is applied to field seams in the same manner as the slope seams. A cross section of a field seam joint after the bituminous material has been applied is shown in FIG. 3. The material is also applied in a similar manner to flashings at the edges of the roof and around protrusions that extend through the roof.

Once the bituminous composite material has been applied and cooled, a incredibly strong bond exists between the material and the roof surface. Tests have shown that this resists wide temperature variations and moisture penetration as well as weight and deformation due to snow or ice on the roof or attempted relative movement between adjacent roof sheets. A life of a seal could be expected to be ten years or longer. The roof can be coated with a compatible paint or similar product after the sealing material has been applied.

Figure 4:
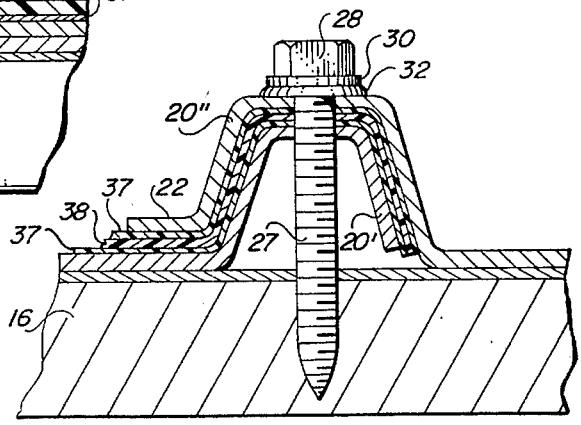
FIG. 4 is a cross sectional view of a sloped seam showing an alternative sealing method.

While it is preferred to apply the bituminous composite material over the roof seams, it is also possible to apply the material between the overlapping layers of roofing in either new roof applications or in a resealing operation. To do this, the sheets of metal roofing are separated after the fasteners have been removed and then the opposed surfaces thereof are cleaned and primed. The bituminous composite material is then heated and applied on the lower layer between the overlapping sheets of roofing. The upper layer is then laid in place and screwed down. The upper layer is then heated from the outside to melt and fuse or bond the bituminous composite material between the primed roof sheeting layers. At this point, the screws are retightened. The bituminous composite material preferably is applied over the top of overlapping ribs, as shown by material 38 in FIG. 4. The material can satisfactorily seal the seams if it extends under only the outer portion of the seam. This same process can be applied to new and resealed field seams and other metal seams in the metal roof.

The foregoing represents a preferred embodiment of the present invention and is not intended to limit the scope of the present invention, as defined in the attached claims.

I claim:

1. A process for sealing a sloped metal roof wherein separate sheets of corrugated metal roof sheeting overlap to form roof seams and wherein such seams loosen and become leaky over a period of time, the process comprising:

applying elongated strips of a flexible hot melt thermoplastic bituminous composite material over the seams and the edges of the roof surface immediately adjacent thereto but not over the whole roof surface, the bituminous composite material having an elevated operating temperature that requires heating for the material to achieve a state where bonding on the metal roof will occur during application, the bituminous composite material, being heated to the operating temperature so as to become soft and semi-molten, the heated bituminous composite material conforming with the surface of the roof and the convolutions of the corrugations and bonding to the roof surface.

2. A process according to claim 1 wherein the bituminous composite material comprises an asphalt impregnated polyester material and has an operating temperature of at least about 500°–600° F.

3. A process according to claim 2 wherein the bituminous composite material comprises type 4 asphalt and includes a polymer as a toughening additive.

4. A process according to claim 1 wherein the surface of the roof at the roof seam is first coated with a compatible metal primer and then bituminous composite material is applied over the primer, the bituminous composite material being heated simultaneously as it is applied, so as to enhance the bonding between the bituminous composite material and the primed roof surface.

5. A process according to claim 1 wherein the roof is a previously constructed roof that is being resealed, the roof sheeting having previously been mounted on framework for the building by threaded fasteners that extend through overlapping portions of adjacent sheeting sections at the roof seams and engage the framework, the fasteners being removed and replaced with new fasteners prior to application of the bituminous composite material to the roof seams, the bituminous composite material being applied over the new fasteners.

6. A process according to claim 1 wherein the strips of bituminous composite material are about six to about twelve inches wide.

7. A process according to claim 1 wherein the bituminous composite material is a modified bitumen product known as a torch down or heat weld material.

8. A process according to claim 6 wherein the bituminous composite material is an asphalt impregnated polyester material that has plastic resin embedded in the asphalt.

9. A process according to claim 1 wherein the process is applied to both sloped seams and field seams in the sloped metal roof.

10. A process according to claim 9 wherein the process is employed for flashings for protrusions and other metal seams in a metal roof.

11. A process according to claim 1 wherein the bituminous composite material is troweled into place with a trowel when it is being applied so as to produce a feathered edge between the material and the roof surface and to eliminate voids between the material and the roof surface.

12. A process for sealing overlapping seams in a sloped metal roof wherein an upper layer overlaps a lower layer of metal roof at the roof seams, comprising applying a strip of a hot melt bituminous composite material to an upper surface of an overlapping portion of the lower layer while at the same time heating the bituminous composite material to an elevated operating temperature that is required before the material achieves a secure bond with the underlying metal roof, the upper layer being laid on the lower layer after application of the bituminous composite material, the upper and lower layers thereafter being fastened to an underlying roof structure by fasteners that extend through the overlapping portions of the upper and lower layers and through the bituminous composite material positioned between the layers, the upper layer thereafter being heated so as to seat the upper layer in the underlying bituminous composite material, the fasteners thereafter being re-tightened down on the overlapping layers.

13. A process according to claim 12 wherein a compatible asphalt primer is applied to opposing upper and lower surfaces of the overlapping metal sheets prior to application of the bituminous composite material to the overlapping surfaces.

* * * * *